US005120456A

United States Patent [19]

Goyal et al.

[11] Patent Number: 5,120,456

[45] Date of Patent: Jun. 9, 1992

[54] TRIAZOLE/ARYLAMINE-MODIFIED SULFONATES AS MULTIFUNCTIONAL ADDITIVES FOR LUBRICANTS

[75] Inventors: Arjuan K. Goyal, Woodbury; Andrew G. Horodysky, Cherry Hill, both of N.J.; Derek A. Law, Yardley; Shi-Ming Wu, Newtown, both of Pa.

[73] Assignee: Mobil Oil Corp., Fairfax, Va.

[21] Appl. No.: 639,862

[22] Filed: Jan. 11, 1991

[51] Int. Cl.[5] ..... C10M 135/14; C10M 141/06

[52] U.S. Cl. ..... 252/46.4; 252/33; 252/47.5; 564/80

[58] Field of Search ..... 252/46.4, 47.5, 33; 564/80

[56] References Cited

U.S. PATENT DOCUMENTS 4,181,619 1/1980 Schmitt ..... 252/32.5

*Primary Examiner*—Brian E. Hearn
*Assistant Examiner*—Maria Nuzzolillo
*Attorney, Agent, or Firm*—Alexander J. McKillop; Charles J. Speciale; Howard M. Flournoy

[57] ABSTRACT

Reaction products of aryltriazoles or arylamines and arylsulfonic acids pre-reacted or formed in-situ in lubricants provide multifunctional antioxidant, antiwear and corrosion-inhibiting properties thereto.

17 Claims, No Drawings

TRIAZOLE/ARYLAMINE-MODIFIED SULFONATES AS MULTIFUNCTIONAL ADDITIVES FOR LUBRICANTS

BACKGROUND OF THE INVENTION

This invention is directed to triazole/arylamine-modified sulfonates as multifunctional lubricant additives and to lubricant compositions containing same.

Metallic aryl sulfonates such as calcium dinonylnaphthalene sulfonates have been widely used in petroleum and synthetic lubricants as rust and corrosion inhibiting additives. Additionally, these and related metallic aryl sulfonates have, on occasion, provided good detergency and demulsibility properties in a variety of lubricant formulations.

Lubricant in service applications often generate acid species or acid-forming species, especially when exposed to high operating temperatures, extended service life and/or contact with atmospheric oxygen during aeration caused by churning or moving elements of the lubricated machine. Acid-forming species can also be formed via hydrolysis, thermal decomposition, or other similar mechanisms.

If metallic arylsulfonates are used as additives in such systems described above, neutralization or acidification to form sulfonic acids can occur. If both metallic aryl sulfonates and aryltriazoles or arylamines are used together in a lubricant, or alternatively pre-reacted, these arylsulfonic acids and aryltriazoles or arylamines can react to form sulfonamides or sulfonium salts.

SUMMARY OF THE INVENTION

This application discloses and is more particularly directed to the reaction products of aryltriazoles or arylamines and arylsulfonic acids pre-reacted, or formed in-situ in lubricants, made by incorporating hydrocarbyltriazoles or arylamines onto the backbone of arylsulfonic acids, to provide multifunctional antioxidant, antiwear, and corrosion inhibiting properties. This application is also directed to improved antioxidant, antiwear and corrosion-inhibiting lubricant compositions. Additional properties expected when used in lubricants and/or fuels are antifatigue, antirust extreme pressure, cleanliness, detergency, dispersancy, thermal stabilities and demulsifying or emulsifying properties.

The product of the present invention can be made by the direct reaction of partially neutralized or acidified metallic arylsulfonates and arytriazoles or arylamines. The arylsulfonates may be acidified or neutralized by means of small quantities of inorganic acids or by acid halides or formed in service or in-situ.

The use of reaction products of acidified sulfonates and aryltriazoles or arylamines as multifunctional antioxidant/antiwear/anticorrosion lubricant additives to the best of applicants' knowledge has not been reported in the literature and is believed to be novel. The composition of matter, lubricant compositions containing such additives, and the use of such reaction products in lubricants to improve the performance properties are all believed to be unique and unobvious.

It is, therefore, an object of this invention to provide improved lubricant compositions, novel multifunctional lubricant additives, and the use of the herein described novel additive products of reaction in such compositions.

DESCRIPTION OF SPECIFIC EMBODIMENTS

Metallic hydrocarbyl aryl sulfonates can be neutralized in service, in situ, or via addition of small quantities of organic or inorganic acids, as shown below:

$$ArSO_3M + H^+ \rightarrow ArSO_3H$$

Where Ar is dialkylnaphthalene, or dihydrocarbylarenes, or monoalkyl or monohydrocarbylarenes, and M is alkali, or alkaline-earth metal and/or a nitrogenous group such as amine or ammonium.

Any appropriate hydrocarbyl triazole selected from cyclic, acyclic, hydrocarbyl substituted, alkyl or aryl triazoles can be used herein. Preferred are aryltriazoles. Arylamines include primary and secondary amines, such as anilines, alkylated anilines, naphthylamines, alkylated naphthylamines, diphenylamines, dinaphthylamines, N-phenyl-1-naphthylamine, N-phenyl-2-naphthylamine, N-aryl-1-napthylamines, N-aryl-1-alkylnapthylamines, N-aryl-2-napthylamines, N-aryl-2-alkylnaphthylamines and the like. The preferred arylamines are N-aryl-1-naphthylamines.

Alternatively, metallic aryl sulfonates may neutralize or acidify to form arylsulfonic acids, which can then be converted to arylsulfonyl halides, with inorganic acid chlorides, such as is thionyl chloride. Arylsulfonyl chlorides thus formed can react with aryltriazoles to give only the corresponding sulfonamides and avoid the sulfonium salts as shown in Example 3.

Conditions for the above reactions may vary widely depending upon specific reactants, the presence or absence of a solvent and the like. Any suitable set of reaction conditions known to the art may be used. Hydrocarbon solvents such as toluene or xylenes are frequently used.

Generally stoichiometric or equimolar ratios of reactants are used. However, more than molar or less than molar amounts may be used. In any event, reaction conditions are not viewed as critical.

The additives embodied herein are utilized in lubricating oil or grease compositions in an amount which imparts significant antioxidant/antiwear/anticorrosion characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %.

The additives can also be used in hydrocarbon fuels, oxygenated fuels, and mixtures at concentration of from about 0.00001% to about 0.1% by weight based on the total weight of the fuel composition.

The additives have the ability to improve the antioxidant/antiwear characteristics of various oleagenous materials such as hydrocarbyl lubricating media which may comprise liquid oils in the form of either a mineral oil or a synthetic oil, or mixtures or mineral oils and or synthetic oils, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. and preferably, from about 50 to about 250 SSU at 210° F. These oils may have viscosity indexes ranging to about 95 or greater wherein the average molecular weights may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which is normally employed for thickening or gelling hydrocarbon fluids for foaming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

It is to be understood, however, that the compositions contemplated herein can also contain other materials. For example, corrosion inhibitors, extreme pressure agents and the like can be used as exemplified respectively by metallic phenates, sulfonates, carboxylates, salicylates, polymeric succinimides, esters, amides and/or imides, non-metallic or metallic phosphorodithioates and the like. These materials do not detract from the value of the compositions of this invention, rather the materials serve to impart their customary properties to the particular compositions in which they are incorporated.

The following examples are merely illustrative and not meant to be limitations.

EXAMPLE 1

Approximately 192 g of calcium dinonylnaphthalene sulfonate (commercially obtained from King Industries, Inc. as Nasul 729) and 100 ml of toluene were charged to a one-liter, four-neck flask equipped with condenser, thermometer, nitrogen sparger and mechanical stirrer, to which 8 ml of 30% sulfuric acid was added and stirred at 70° C. for one hour. A solution of tolyltriazole (26.6 g, 0.20 mol) in 50 ml of toluene was introduced and the mixture was heated to reflux for four hours. The resulting reaction mixture was filtered. The filtrate was washed with water and evaporated under a reduced pressure at 130° C. to yield 215 g of viscous brown fluid.

EXAMPLE 2

Under the exact same reaction conditions as described in Example 1, the calcium sulfonate was acidifed and reacted with N-phenyl-1-napthylamine (44 g, 0.20 mol). Approximately 234 g of viscous dark greenish brown fluid was obtained as the final product.

EXAMPLE 3

Under the same general reaction conditions as described in Example 1, approximately 192 g of calcium sulfonate was acidified with 8 ml of 30% sulfuric acid at 70° C. for one hour, and the reaction mixture was heated up to reflux to distill off the aqueous portion in a Dean-Stark trap. The reaction mixture was then cooled to 70° C., to which a solution of thionyl chloride. (24,8 g, 0.21 mol) in 30 ml of toluene was added dropwise. The resulting mixture was stirred for one hour at 70° C. after addition. Finally, a solution of tolyltriazole (26.6 g, 0.20 mol) in 50 mol of toluene was introduced and the mixture was heated to reflux for four hours. 220 g of dark brown fluid was obtained as the final product.

Evaluation of Products

The products of the examples were blended into solvent paraffinic neutral mineral oil and evaluated by Catalytic Oxidation Test (Table 1). Confirmation of the antiwear properties is shown by Four-Ball Wear Test (Table 2).

Basically, in the catalytic oxidation test, the lubricant is subjected to a stream of air which is bubbled through at the rate of five liters per hour at elevated temperatures for a specified time (Table 1, 325° F. for 40 hours). Present in the composition are samples of metals commonly used in engine construction, namely, iron, copper, aluminum, and lead. See U.S. Pat. No. 3,682,980, incorporated herein by reference.

TABLE 1

| | Catalytic Oxidation Test (325° F., 40 hr) | |
|---|---|---|
| Item | Change In Acid Number Δ TAN | Percent Change In Kinematic Viscosity Δ KV % |
| Base oil (100% solvent paraffinic neutral mineral oil) | 15.79 | 211.0 |
| 1% Example 1 in above base oil | 0.26 | 29.3 |
| 1% Example 2 in above base oil | 0.63 | 5.3 |
| 1% of Example 3 in above base oil | 0.09 | 1.0 |

The remarkable antioxidant performance of these reaction products is evident, as demonstrated by excellent control of increases in both acidity and viscosity.

In the Four-Ball Wear Test, three stationary balls are placed in the lubricant cup and the lubricant containing the compound to be tested is added thereto, and a fourth ball is placed in a chuck mounted on a device which can be used to spin the ball at known speeds and loads. The samples were tested using ½ inch stainless steel balls of 52100 steel for 30 minutes.

TABLE 2

| | Four-Ball Wear Test (40 kg load, 200° F., 2000 rpm, 30 min) |
|---|---|
| Item | Wear Scar Diameter, mm |
| Base oil (80% solvent paraffinic | 1.72 |

TABLE 2-continued

| Item | Four-Ball Wear Test (40 kg load, 200° F., 2000 rpm, 30 min) Wear Scar Diameter, mm |
|---|---|
| bright, 20% solvent paraffinic neutral mineral oils) | |
| 1% of Example 1 in above base oils | 0.55 |
| 1% of Example 2 in above base oils | 0.75 |
| 1% of Example 3 in above base oils | 0.52 |

The results of the Four-Ball Wear Tests clearly show good antiwear activity of these reaction products. The use of additive concentrations of reaction products of the above disclosed compositions in premium quality industrial, automotive and marine lubricants will provide improved multifunctional antioxidant/antiwear-/anticorrosion properties to such compositions.

What is claimed is:

1. A product of reaction having multifunctional antiwear/antioxidant/anticorrosion characteristics when admixed with various lubricating media prepared by reacting hydrocarbyl triazoles selected from a cyclic, hydrocarbyl substituted alkyl or aryltriazoles or arylamines selected from the group consisting of anilines, alkylated anilines, naphthylamines, alkylated naphthylamines, diphenyl amines, dinaphthylamines, N-phenyl-1-naphthylamines, N-phenyl-2-naphthylamines, N-aryl-1-naphthylamines, N-aryl-1-alkyl-naphthylamines, N-aryl-2-naphthylamines, and N-aryl-2-alkyl-naphthylamines with neutralized or acidified metallic arylsulfonates wherein the metallic aryl sulfonate is acidified or neutralized in service, in situ or via the reaction of small quantities of organic or inorganic acids as shown below:

$$ArSO_3M + H^+ \rightarrow ArSO_3H$$

where Ar is a dihydrocarbylnaphthalene, dihydrocarbylarene, monohydrocarbylarene or polyhydrocarbylarene and M is an alkali or alkaline-earth metal or a nitrogenous group selected from an amine or ammonium group and wherein the reaction temperature varies from ambient to slightly higher and the molar ratio of reactants varies from molar to less than molar to more than molar.

2. The product of claim 1 comprising (1) first reacting an acidified or partially acidified metallic aryl sulfonate with an inorganic acid halide and thereafter (2) reacting the resultant arylsulfonyl halide with an hydrocarbyl triazole or arylamine.

3. The product of claim 2 where the inorganic halide is selected from the group consisting of thionyl bromide or thionyl chloride.

4. The product of claim 3 where the inorganic halide is thionyl chloride.

5. The product of claim 1 where the metallic aryl sulfonate is calcium dinonylnaphthalene sulfonate.

6. The product of claim 1 where the aryltriazole reactant is tolyltriazole.

7. The product of claim 1 where the arylamine reactant is N-phenyl-1-naphthylamine.

8. An improved lubricant composition consisting of a major amount of an oil of lubricating viscosity or grease prepared therefrom and a minor multifunctional antioxidant/antiwear/anticorrosion amount of a product of reaction prepared by reacting hydrocarbyl triazoles selected from acyclic hydrocarbyl substituted alkyl or aryltriazoles or arylamines selected from the group consisting of anilines, alkylated anilines, napthylamines, alkylated naphthylamines, diphenyl amines, dinaphthylamines, N-phenyl-1-naphthylamines, N-phenyl-2-naphthylamines, N-aryl-1-naphthylamines, N-aryl-1-alkyl-naphthylamines, N-aryl-2-naphthylamines, and N-aryl-2-alkyl-naphthylamines with acidified or neutralized metallic arylsulfonates wherein the metallic aryl sulfonate is acidified or neutralized in service, in situ or via the reaction of small quantities of organic or inorganic acids as shown below:

$$ArSO_3M + H^+ \rightarrow ArSO_3H$$

where Ar is a dihydrocarbylnaphthalene, dihydrocarbylarene, monohydrocarbylarene or polyhydrocarbylarene and M is an alkali or alkaline-earth metal or a nitrogenous group selected from an amine or ammonium group and wherein the reaction temperature varies from ambient to slightly higher and the molar ratio of reactants varies from molar to less than molar to more than molar.

9. The composition of claim 8 where said product is prepared by (1) first reacting metallic aryl sulfonate with an inorganic acid halide and thereafter (2) reacting the resultant arylsulfonyl halide with an hydrocarbyl triazole or arylamine.

10. The composition of claim 9 where the inorganic halide is selected from the group consisting of thionyl bromide or thionyl chloride.

11. The composition of claim 10 where the inorganic halide is thionyl chloride.

12. The composition of claim 8 where the metallic aryl sulfonate is calcium dinonylnaphthalene sulfonate.

13. The composition of claim 1 where the aryltriazole is tolytriazole.

14. The composition of claim 8 where the arylamine is N-phenyl-1-naphthylamine.

15. The composition of claim 8 containing from about 0.001 to about 10 wt % based on the total weight of the composition of said multifunctional antioxidant/antiwear/anticorrosion additive product of reaction.

16. The composition of claim 8 where said lubricant is selected from (1) mineral oils, (2) synthetic oils, (3) a mixture of mineral and synthetic oils or (4) is a grease prepared from any one of (1), (2), or (3).

17. A method of improving the lubricity and antioxidant/antiwear/anticorrosion characteristics of a lubricant composition comprising adding to an oil of lubricating viscosity or grease prepared therefrom from about 0.001 to about 10 wt % of the multifunctional additive product of reaction described in claim 1.

* * * * *